US006875732B2

(12) United States Patent
Jurek et al.

(10) Patent No.: US 6,875,732 B2
(45) Date of Patent: Apr. 5, 2005

(54) FRAGRANCE DELIVERY SYSTEM

(75) Inventors: Michael J. Jurek, Oak Ridge, NJ (US); Purvita Shah, Jersey City, NJ (US); Kolazi S. Narayanan, Wayne, NJ (US)

(73) Assignee: ISP Investments Inc., Wilmington, DE (US)

( * ) Notice: Subject to any disclaimer, the term of this patent is extended or adjusted under 35 U.S.C. 154(b) by 0 days.

(21) Appl. No.: 10/669,048

(22) Filed: Sep. 23, 2003

(65) Prior Publication Data

US 2005/0032655 A1 Feb. 10, 2005

Related U.S. Application Data

(60) Provisional application No. 60/493,886, filed on Aug. 8, 2003.

(51) Int. Cl.[7] ..... C11D 3/50
(52) U.S. Cl. ..... 510/101
(58) Field of Search ..... 510/101, 500; 512/2, 3

(56) References Cited

U.S. PATENT DOCUMENTS

| | | | | | |
|---|---|---|---|---|---|
| 4,808,569 | A | * | 2/1989 | Chaudhuri et al. | 512/2 |
| 5,093,031 | A | * | 3/1992 | Login et al. | 516/68 |
| 5,326,789 | A | * | 7/1994 | Narayanan | 514/788 |
| 5,641,742 | A | * | 6/1997 | Adamy et al. | 510/500 |
| 6,414,139 | B1 | * | 7/2002 | Unger et al. | 556/413 |
| 6,566,308 | B1 | * | 5/2003 | Aven | 504/347 |

* cited by examiner

*Primary Examiner*—John R. Hardee
(74) *Attorney, Agent, or Firm*—William J. Davis; Walter Katz

(57) ABSTRACT

A micro-emulsified fragrance composition provides an effective fragrance delivery system when present in a laundry composition, e.g. a laundry fabric softener formulation, or when delivered from a substrate. This composition can deposit a substantial amount of fragrance material onto the surface intended for deposition during the wash, rinse, dry, or post-dry cycles.

16 Claims, No Drawings

FRAGRANCE DELIVERY SYSTEM

CROSS REFERENCE TO RELATED APPLICATIONS

This application corresponds to U.S. Provisional Patent Application Ser. No. 60/493,886, filed on Aug. 8, 2003, the complete disclosure of which is hereby incorporated by reference.

BACKGROUND OF THE INVENTION

1. Field of the Invention

This invention relates to a fragrance delivery system, and, more particularly, to fabric treatment with perfumes and compositions, and products for accomplishing such treatment.

2. Description of the Prior Art

Fragrances typically comprise only up to 1% by weight of a laundry product, yet about 85% of the fragrance is lost in the wash/rinse cycle. Accordingly, the laundry industry has tried to develop fragrance-containing compositions which deposit a substantial proportion of its fragrance onto the fabric in an esthetically pleasing manner. See U.S. Pat. Nos. 4,152,272; 4,402,856; 4,446,032; 4,464,271; 4,919,841; 4,946,624; 4,954,285; 4,973,422; 5,066,419; 5,094,761; 5,102,564; 5,112,688; 5,126,061; 5,137,646; 5,154,842; 5,232,612; 5,234,610; 5,234,611; 5,236,615; 5,425,887; 5,476,660; 6,024,943; 6,042,792; 6,051,540; 6,083,899; 6,328,988; 6,395,695; 6,531,444 and 6,550,474.

SUMMARY OF THE INVENTION

What is described herein is a fragrance delivery system which includes, by weight, (a) 2–50% of an active fragrance, (b) 50–98% of a microemulsion concentrate including:

(i) 0.03–80% of a non-ionic surfactant, (ii) 0.00240% of a N—$C_8$–$C_{18}$ is alkyl pyrrolidone, (iii) 0–60% of a N—$C_1$–$C_4$ alkyl pyrrolidone, (iv) 0–30% of an ethylene oxide/propylene oxide block copolymer, and (v) 0–10% of an ethoxylated phosphoric acid ester.

In a preferred embodiment of the invention, (a) is 5–20%; (b) is 80–95%, (b) (i) is 40–70%; (b) (ii) is 0.05–29%; (b) (iii) is 0.1540%; (b) (iv) is 0.5–15%; and (b) (v) is 0.005–6%.

Suitably, (b) has a particle size of <0.1$\mu$, preferably about 0.05$\mu$, and the fragrance delivery system itself has about the same particle size as (b).

Preferably the fragrance material is a liquid.

Suitably components (b) (i) is castor oil ethoxylate or tristyrl phenol ethoxylate, (b) (ii) is octyl pyrrolidone and (b) (iii) is methylpyrrolidone.

The fragrance delivery system of the invention preferably is used in a laundry composition such as a laundry detergent composition, which can be a non-ionic, anionic, cationic or neutral formulation; or a laundry washing composition which is an anionic formulation; or a fabric softener composition which is a cationic formulation.

Suitably, such laundry compositions include, by weight, 0.1–10% of the fragrance delivery system of the invention.

Suitably, the fragrance delivery system of the invention can be applied to a fabric while retaining at least 10% of its applied weight to impart at least 50 ppm of the fragrance on the fabric.

In an alternative embodiment of the invention, the fragrance delivery system can be delivered from a substrate such as a non-woven fabric or dryer sheet on or in which the system is applied.

The invention herein also includes a method of delivering a fragrance to a textile, fabric or clothes which comprises applying the fragrance delivery system thereto in the wash, rinse, dry, or post-dry cycle.

DETAILED DESCRIPTION OF THE INVENTION

In accordance with the invention, there is described herein a novel method of delivering fragrances that can be applied to various substrates, including textiles, fabrics and clothes, during the wash, rinse, dry, or post-dry cycle. In this method of delivery, a higher percent retention of the fragrance on the substrate can be achieved as compared to delivering the fragrance in a conventional solvent or neat.

The present invention provides a concentrate of fragrance plus microemulsion matrix which is compatible in laundry media with high levels of emulsifiers, both anionic and non-ionic, found in typical laundry/cleaning formulations. Upon high dilution conditions typically employed in washing machine cycles, the concentrated fragrance becomes micro-emulsified and can deliver the fragrance in an effective manner to the fabric.

The micro-emulsified fragrance composition of this invention vastly increases the available surface area of the fragrance in relation to the fabric surface intended for deposition/interaction. This increased surface area in turn augments interactions/deposition between fabric and fragrance, hence improving the efficacy of use. Accordingly, this invention system enhances delivery of fragrance molecules by increasing the available surface area for interaction between the substrate and the desired fragrance molecules.

Microflex® (International Specialty Products, Inc.) is a micro-emulsifier employed herein to prepare compositions having particle sizes of <0.1$\mu$ that contain an active fragrance molecule. The Microflex®-based fragrance delivery system of the invention includes a wetting component, e.g. N-octyl pyrrolidone, which enhances adsorption of the solvated fragrance onto the fabric via N-octyl pyrrolidone/co-surfactant based micelles. After completion of the wash cycle, the adsorbed fragrance has an increased residence time on the fabric, thus resulting in reduced loss of fragrance during the wash cycle. The lamellar configuration of the micelles on the adsorbed fabric surface also facilitates penetration of the fragrance into the structured fabric.

Fragrance

The fragrance that can be encapsulated in the system of the present invention can be any odoriferous material and can be selected according to the desires of the fragrance creator. In general terms, such fragrance materials are characterized by a vapor pressure below atmospheric pressure at ambient temperatures. The high boiling perfume materials employed herein will most often be solids at ambient temperatures, but also can include high boiling liquids. A wide variety of chemicals are known for perfumery uses, including materials such as aldehydes, ketones, esters, and the like. More commonly, naturally occurring plant and animal oils and exudates comprising complex mixtures of various chemical components are known for use as fragrances, and such materials can be used herein. Fragrances useful for the present invention can be a single aroma chemical, relatively simple in their composition, or can comprise highly sophisticated, complex mixtures of natural and synthetic chemical components, all chosen to provide any desired odor.

Suitable fragrances which can be used in the present invention comprise, for example the high boiling components of woody/earthy bases containing exotic materials such as sandalwood oil, civet, patchouli oil, and the like. The perfumes herein can be of a light, floral fragrance, such as for example, high boiling components of rose extract, violet extract, and the like. The perfumes herein can be formulated to provide desirable fruity odors, such as for example lime, lemon, orange, and the like. The perfume can be any material of appropriate chemical and physical properties which exudes a pleasant otherwise desirable odor when applied to fabrics. Perfume materials suitable for use in the present invention are described more fully in S. Arctander, *Perfume Flavors and Chemicals*, Vols. 1 and 11; and the *Merck Index,* 8$^{th}$ Edition, Merck & Co., Inc. both references being incorporated herein by reference.

A combination of surfactants can be used with the Microflex® system, to provide, e.g. synergistic interactions between anionic surfactants and Microflex®, and also between non-ionic surfactants and the Microflex® formulation. Typical anionic surfactants include alkylbenzenesulfonates, alkanesulfonates, olefinsulfonates, alkyl ether sulfonates, glycerol ether sulfonates, alpha-methyl ester sulfonates, sulfo fatty acids, alkyl sulfates, fatty alcohol ether sulfates, glycerol ether sulfates, hydroxyl-mixed ether sulfates, monoglyceride (ether) sulfates, fatty acid amide (ether) sulfates, mono- and dialkyl sulfosuccinates, mono- and dialkyl sulfosuccinamates, sulfotriglycerides, amide soaps, ether carboxylic acids and salts thereof, fatty acid isethionates, fatty acid sarcosinates, fatty acid taurides, n-acyl amino acids such as, for example, acyl lactylates, acyl tartrates, acyl glutamates and acyl aspartates, alkyl oligoglucoside sulfates, protein fatty acid condensates (especially plant products based on wheat), and alkyl (ether) phosphates. Where the anionic surfactants contain polyglycol ether chains, these chains may have a conventional or, preferably, a narrowed homolog distribution. Preference is given to using alkylbenzenesulfonates, alkyl sulfates, soaps, alkanesulfonates, olefinsulfonates, methyl ester sulfonates, and mixtures thereof.

Suitable non-ionic surfactants include Neodol®–25–9; fatty alcohol polyglycol ethers, alkylphenol polyglycol ethers, fatty acid polyglycol esters, fatty amide polyglycol ethers, fatty amine polyglycol ethers, alkoxylated triglycerides, mixed ethers and mixed formals, alk(en)yl oligoglycosides, fatty acid N-alkylglucamides, protein hydrolysates (especially plant products based on wheat), polyol fatty acid esters, sugar esters, sorbitan esters, polysorbates and amine oxides. Where the nonionic surfactants contain polyglycol ether chains, these chains may have a conventional or, preferably, a narrowed homolog distribution. Preference is given to using fatty alcohol polyglycol ethers, alkoxylated fatty acid lower alkyl esters or alkyl oligoglucosides and polyethylene glycollpropylene glycol copolymers.

Typical fragrance compounds are aldehydes having the formulas:

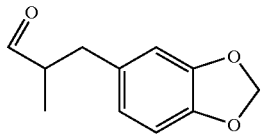

HELIONAL

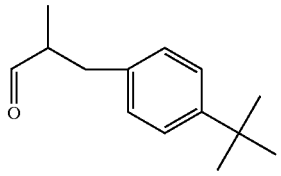

LILIAL

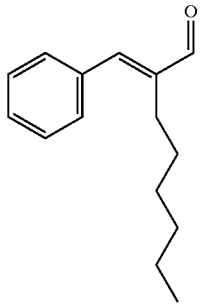

HEXYL CINNAMIC ALDEHYDE

The invention will now be described with reference to the following examples.

A. Preparation of Fragrance Delivery Systems of Invention

EXAMPLE 1

A stable fragrance delivery system was prepared by using Microflex® and lilial as fragrance. Accordingly, to 90 g of Microflex® was slowly added 10 g of lilial with stirring at a speed of 200 rpm for 15 minutes. The resulting solution was slightly yellow in color.

EXAMPLE 2

The procedure of Example 1 was followed to provide a concentrate of 90 g of Microflex® and 10 g of tetrahydro citral. The solution was slightly yellow in color.

EXAMPLE 3

The procedure of Example 1 was followed to provide a concentrate of 90 g of Microflex® and 10 g of hexyl cinnamic aldehyde. The solution was slightly yellow in color.

EXAMPLE 4

A system was prepared as in Example 1 using a 20:80 ratio of Microflex® to Neodol® 25–9.

EXAMPLE 5

A system is prepared as in Example 1 using a 20:80 ratio of n-octyl pyrrolidone to Tomadol® 1–3 surfactant.

B. Preparation of Laundry Compositions

The fragrance delivery systems of Examples 14 are included in typical laundry compositions, including laundry detergent and fabric softener formulations, in an amount of about 0.1–10% by weight of the system, for use during the wash, rinse, dry, or post-dry cycles.

C. Results

In use in such laundry compositions, the invention fragrance delivery system can deliver a substantial amount of fragrance onto the fabric without losing most of the fragrance in the wash.

While the invention has been described with particular reference to certain embodiments thereof, it will be understood that changes and modifications may be made which are within the skill of the art. Accordingly, it is intended to be bound only by the following claims, in which:

What is claimed is:

1. A fragrance delivery system comprising, by weight, (a) 5–20% of an active fragrance, (b) 80–95% of a microemulsion concentrate including:

(i) 40–70% of a non-ionic surfactant, (ii) 0.05–29% of a N—$C_8$–$C_{18}$ alkyl pyrrolidone, (iii) 0.15–40% a N—$C_1$–$C_4$ alkyl pyrrolidone, (iv) 0.5–15% of an ethylene oxide/propylene oxide block copolymer, and (v) 0.005–6% of an ethoxylated phosphoric acid ester.

2. A fragrance delivery system according to claim 1 wherein (b) has a particle size of $<0.1\mu$.

3. A fragrance delivery system according to claim 2 wherein (b) has a particle size of about $0.05\mu$.

4. A laundry composition which includes the fragrance delivery system of claim 2.

5. A fragrance delivery system according to claim 1 wherein said fragrance is a liquid.

6. A laundry composition according to claim 5 which is a laundry detergent composition.

7. A fragrance delivery system according to claim 1 wherein (b) (i) is castor oil ethoxylate or tristryl phenol ethoxylate, (b) (ii) is octyl pyrrolidone and (b) (iii) is methylpyrrolidone.

8. A laundry composition which includes the fragrance delivery system of claim 1.

9. A laundry composition which is a non-ionic, anionic, cationic or neutral formulation.

10. A laundry washing composition including the fragrance delivery system of claim 1, which is an anionic formulation.

11. A fabric softener composition including the fragrance delivery system of claim 1, which is a cationic formulation.

12. A laundry fabric softener which includes the fragrance delivery system of claim 1.

13. A laundry composition which includes, by weight, 0.1–10% of the fragrance delivery system of claim 1.

14. An article comprising the fragrance delivery system of claim 1 on or in a substrate.

15. An article of claim 14 wherein said substrate is a fabric.

16. A method of delivering a fragrance to a textile, fabric or clothes which comprises applying the fragrance delivery system of claim 1 thereto in the wash, rinse, dry, or post-dry cycle.

* * * * *